US005701709A

United States Patent [19]

Dixon, III

[11] Patent Number: 5,701,709

[45] Date of Patent: Dec. 30, 1997

[54] INSULATION SUPPORT SYSTEM FOR METAL FRAME CONSTRUCTION AND METHOD RELATING THERETO

[76] Inventor: John R. Dixon, III, 2509 General Forrest Cir., Virginia Beach, Va. 23454

[21] Appl. No.: 757,302

[22] Filed: Nov. 27, 1996

[51] Int. Cl.[6] ..... E04B 1/74

[52] U.S. Cl. ..... 52/404.1; 52/742.13; 52/742.1; 52/474; 52/508

[58] Field of Search ..... 52/742.13, 742.1, 52/404.1, 404.3, 407.3, 482, 483.1, 508, 356, 474

[56] References Cited

U.S. PATENT DOCUMENTS

| | | | |
|---|---|---|---|
| 943,696 | 12/1909 | Mooney et al. | 52/356 |
| 969,213 | 9/1910 | Gold et al. | 52/356 X |
| 1,504,325 | 8/1924 | Collins | 52/356 |
| 1,685,247 | 9/1928 | Selway | 52/356 |
| 1,814,202 | 7/1931 | Winget | 52/356 |
| 2,076,728 | 4/1937 | Keller | 52/482 X |
| 2,989,790 | 6/1961 | Brown | 52/742.13 |
| 3,363,371 | 1/1968 | Villalobos | 52/356 X |
| 3,850,073 | 11/1974 | Hayes . | |
| 4,177,618 | 12/1979 | Felter | 52/742.13 |
| 4,385,477 | 5/1983 | Walls et al. | 52/404.3 X |
| 4,523,531 | 6/1985 | Bishara . | |
| 4,594,828 | 6/1986 | Taylor . | |
| 4,712,347 | 12/1987 | Sperber | 52/742.13 X |
| 4,844,651 | 7/1989 | Partridge . | |
| 5,230,597 | 7/1993 | Nuttall . | |
| 5,287,674 | 2/1994 | Sperber | 52/742.13 |
| 5,365,716 | 11/1994 | Munson | 52/742.13 |
| 5,412,919 | 5/1995 | Pellock . | |
| 5,561,957 | 10/1996 | Gauthier . | |

*Primary Examiner*—Robert Canfield
*Attorney, Agent, or Firm*—Joy L. Bryant

[57] ABSTRACT

An insulation support system for metal frame construction is provided. The system comprises an insulation support material and a metal frame. The metal frame comprises a plurality of metal members, wherein at least two opposing metal members have at least one portion thereof stamped out to protrude on one side. An exterior sheathing is attached to an opposing side of the metal frame. The stamped out protrusion engages the insulation support material. This system is particularly useful for steel frame construction and does not require the use of adhesives or additional tools. The method of the present invention involves providing a metal frame having a plurality of metal members wherein at least two opposing members have at least one portion thereof stamped out to protrude on one side and an exterior sheathing attached to an opposing side. An insulation support material is engaged and tensioned on the stamped out protruded portions of the opposing metal members forming a cavity between the insulation support material and the exterior sheathing. Insulation is blown into the cavity. This method allows for positive restraint of the insulation support material and high density insulation. Thus, a high "R" value is achieved. In addition, installation is independent of weather conditions, requires no additional tools, and is more efficient than those systems currently used.

18 Claims, 4 Drawing Sheets

INSULATION SUPPORT SYSTEM FOR METAL FRAME CONSTRUCTION AND METHOD RELATING THERETO

BACKGROUND OF THE INVENTION

The present invention relates to insulation support systems. In particular, it relates to blown-in insulation support systems for metal frame construction.

The blown in blanket (BIB) insulation system has demonstrated a higher thermal resistance per unit of thickness. In addition, the BIB insulation system also dramatically reduces the need for secondary caulking and sealants to reduce air infiltration, making it more desirable than fiberglass blanket (BATT) insulation. The BIB insulation system is comprised of standard chopped fiberglass or Rockwool insulation blown in place with a water and glue mist.

When installing BIB insulation in a wood frame building, a nylon netting or support material is first stapled to the wood frame. The BIB insulation is blown between the structural members and held in place by the nylon netting until the interior wall system is installed. The net tension plays an important role in determining the success of the BIB insulation. Insufficient tension on the net results in a low density insulation, a low "R" value, and thus a poor installation. For wood frame construction this is not a problem since the net is stapled in place.

However, when the BIB insulation was applied to metal frame structures, various problems were encountered. The nylon netting or support material could not be stapled to the metal frame. In turn, the netting was attached by adhering the net to the metal frame. In this process, the adhesive was first placed on the studs and allowed to dry to a predetermined degree of tackiness. The net was then applied to the tacky studs and pulled tight. It was at this point in the application process that problems were encountered. First, it was found that too much tension on the net resulted in the net being pulled off of the studs. When the net was installed using lower tension, a poor installation resulted. In addition, it was found that the adhesive was adversely affected by changes in the temperature and humidity. In cold and or high humidity conditions, the adhesive could not hold the netting at a tension which would retain the BIB insulation before the interior wall system was constructed. In addition, the adhesive took considerable time to apply and to dry.

One approach towards solving these problems was attaching the nylon netting to the metal framework using screws. However, this process was found to be expensive and time consuming. For the foregoing reasons, there is a need for a blown-in insulation support system for metal frame construction which is easy to use, time-saving and low in installation cost.

BRIEF SUMMARY OF THE INVENTION

An object of the present invention is to provide a blown-in insulation support system for metal frame construction.

Another object is to provide a blown-in insulation support system for metal frame construction which does not require the use of an adhesive.

Another object is to provide a blown-in insulation support system for metal construction which allows for construction independent of temperature and humidity conditions.

Another object is to provide a blown-in insulation support system which provides a mechanical means for support which is a part of the metal frame.

By the present invention, a blown-in insulation support system for metal frame construction is provided. The blown-in insulation support system comprises an insulation support material and a metal frame comprising a plurality of metal members, wherein at least two opposing metal members have at least one portion thereof stamped out to protrude on one side and an exterior sheathing attached to an opposing side, and wherein the stamped out protrusion engages the insulation support material.

The insulation support material may be either nylon netting, fabric, reinforced material, or a thin, translucent cloth material. Most preferably, the insulation support material is nylon netting.

The metal members are either primary metal members or secondary metal members or a combination thereof and preferably are formed from steel. Each metal member has a longitudinal axis and the stamped portion and the longitudinal axis form an angle of protrusion.

In particular, a blown-in insulation support system for steel frame construction comprises a nylon net; and a steel frame comprising spaced apart steel top and bottom tracks and a plurality of parallel elongate steel studs extending between the top track and the bottom track spaced at intervals along the length of the track, wherein the top track, the bottom track and the elongate studs each have a longitudinal axis and each has at least one portion thereof stamped out to protrude on one side at an angle of about 20 degrees between the protruded portion and the longitudinal axis and an exterior sheathing attached to an opposing side; and wherein the stamped out protrusion engages the nylon net.

The method of the present invention involves providing a metal frame having a plurality of metal members wherein at least two opposing metal members have at least one portion thereof stamped out to protrude on one side and an exterior sheathing attached to an opposing side; engaging and tensioning an insulation support material on the stamped out protruded portions of the metal frame forming a cavity between the exterior sheathing and the insulation support material; and blowing insulation into the cavity.

The insulation support system for metal frame construction of the present invention allows for construction independent of temperature and humidity conditions. It also provides maximum tension of the insulation support material. Since no tools and adhesives are required, the number of steps in the construction process are greatly reduced.

DETAILED DESCRIPTION OF THE INVENTION

Figure 1:
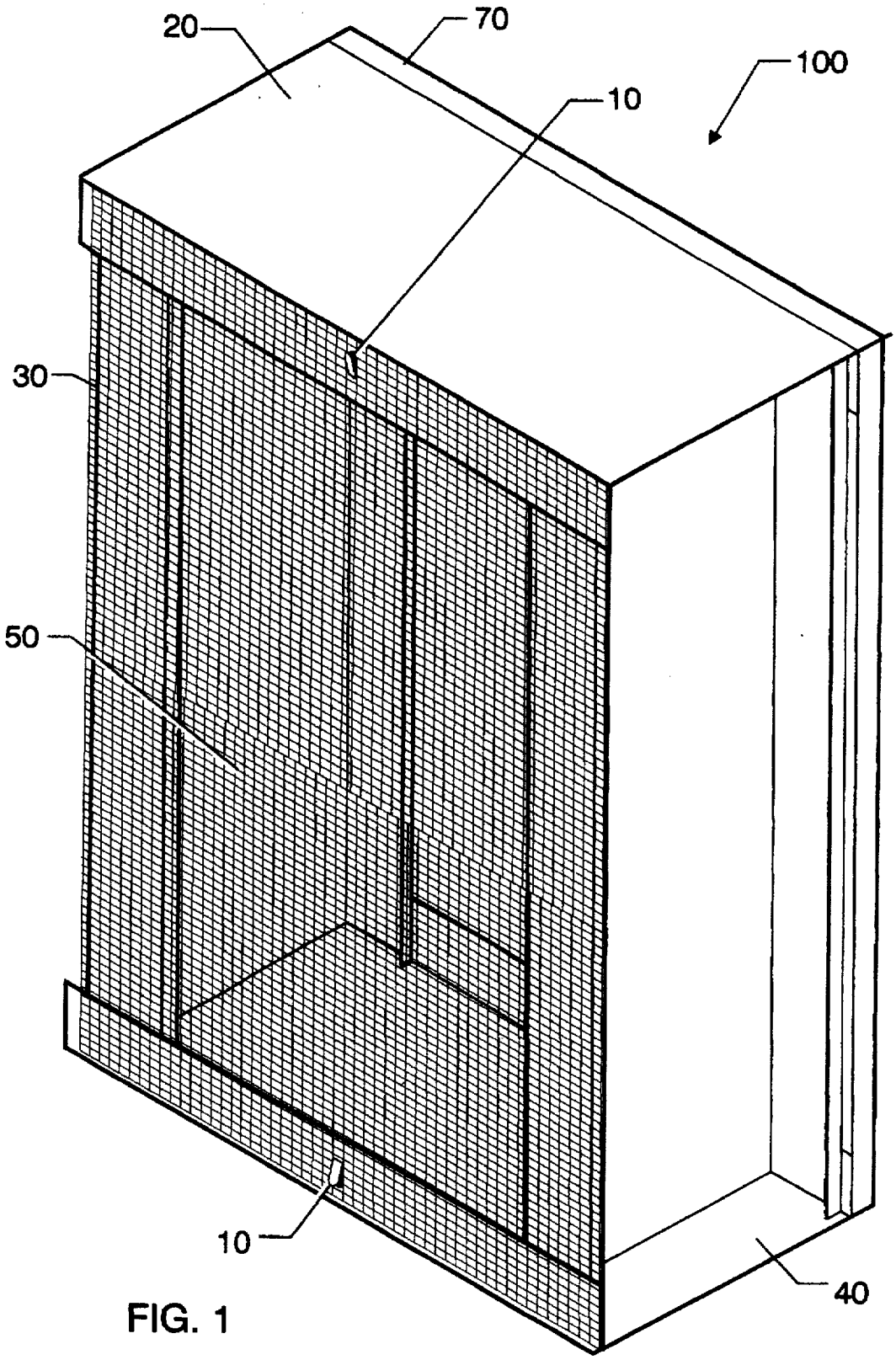
FIG. 1 is an orthographic view of a typical wall showing an embodiment of the present invention.

Referring to the drawings, FIG. 1 is an orthographic view of a typical wall showing the insulation support system for metal frame construction of the present invention 100. In the figure, the primary metal member is a stud 30 and the secondary metal members are the metal top track 20 and the metal bottom track 40. In the figure, only the top and bottom tracks are shown to have at least one portion thereof stamped out to protrude on one side 10. The stamped out protrusion 10 is used to engage the insulation support material 50.

It is not necessary that all the metal members be stamped out nor is it necessary to stamp all sides of the metal members, but rather only the side which will be engaging the insulation support material needs to be stamped. Stamped is defined as forming a perforation in the metal such that one portion of the metal extends outward from the longitudinal axis of the metal member. This may be achieved by either using a hand held die punch or using traditional metal stamping techniques. The direction of the stamped out protrusion may be either upward, downward, right facing or left facing. The only requirement for the present invention is that at least one set of opposing metal members must be stamped to allow for engaging and tensioning the insulation support material. Opposing is defined as members across from one another. For example, the metal top track and the metal bottom track are stamped with the parallel elongated studs not being stamped or the parallel elongated studs are stamped with the metal top and bottom tracks not being stamped. At least one protrusion is needed per opposing metal member to engage the insulation support material. FIG. 1 shows two opposing metal members, the top track 20 and the bottom track 40, each having only one portion thereof stamped out to protrude 10 on the same side as sufficient to hold the insulation support material in place.

Figure 2:
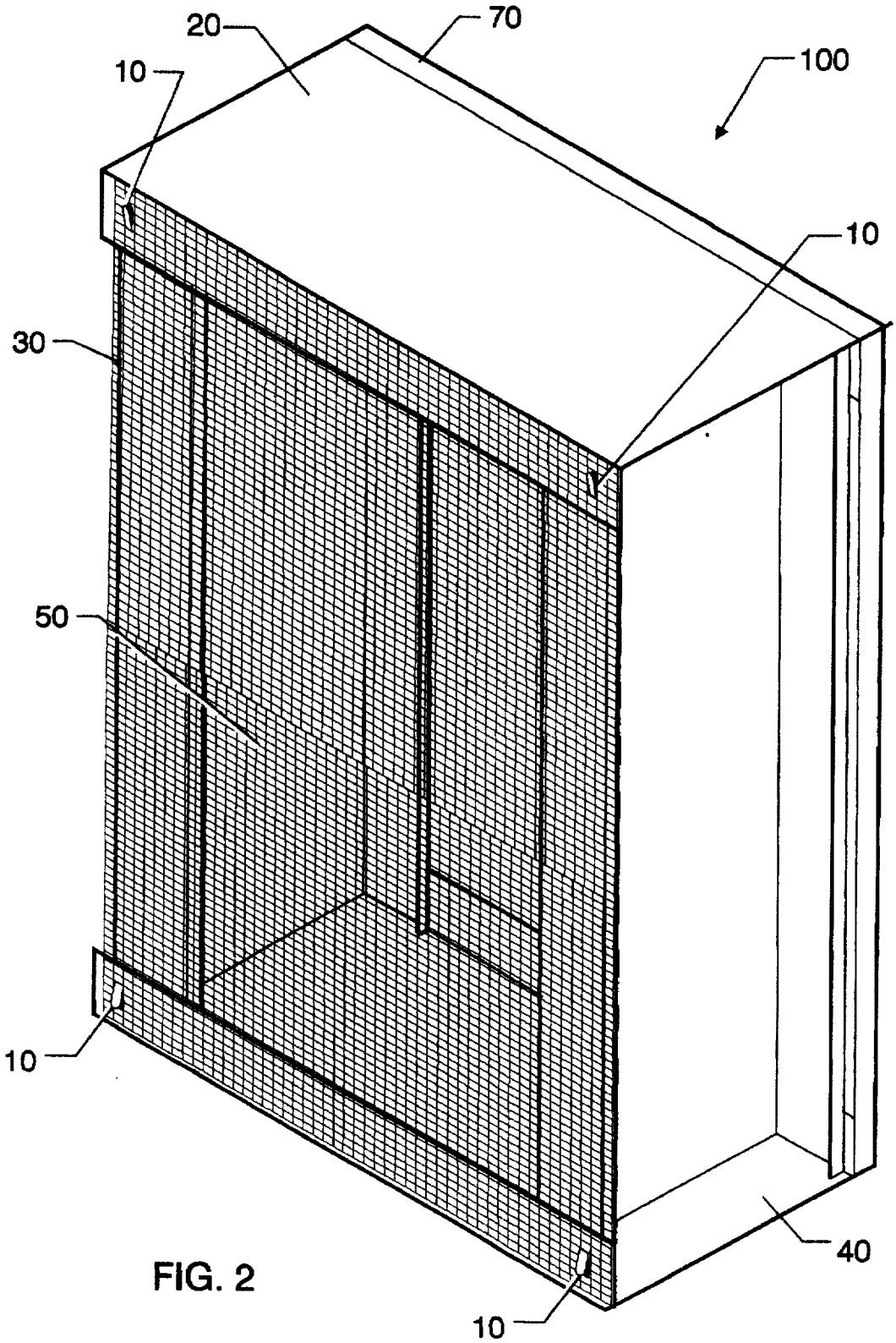
FIG. 2 is an orthographic view of a typical wall showing a second embodiment of the present invention.

As an alternative embodiment of the invention, two opposing metal members, such as the top track and the bottom track, were stamped at each corner to protrude on the same side as shown in FIG. 2. In this embodiment, the two opposing metal members, the top track 20 and the bottom track 40, were stamped out to protrude 10 at opposing corners. The metal studs 30 were not stamped. The insulation support material 50 was engaged and tensioned on each protrusion 10.

Figure 3:
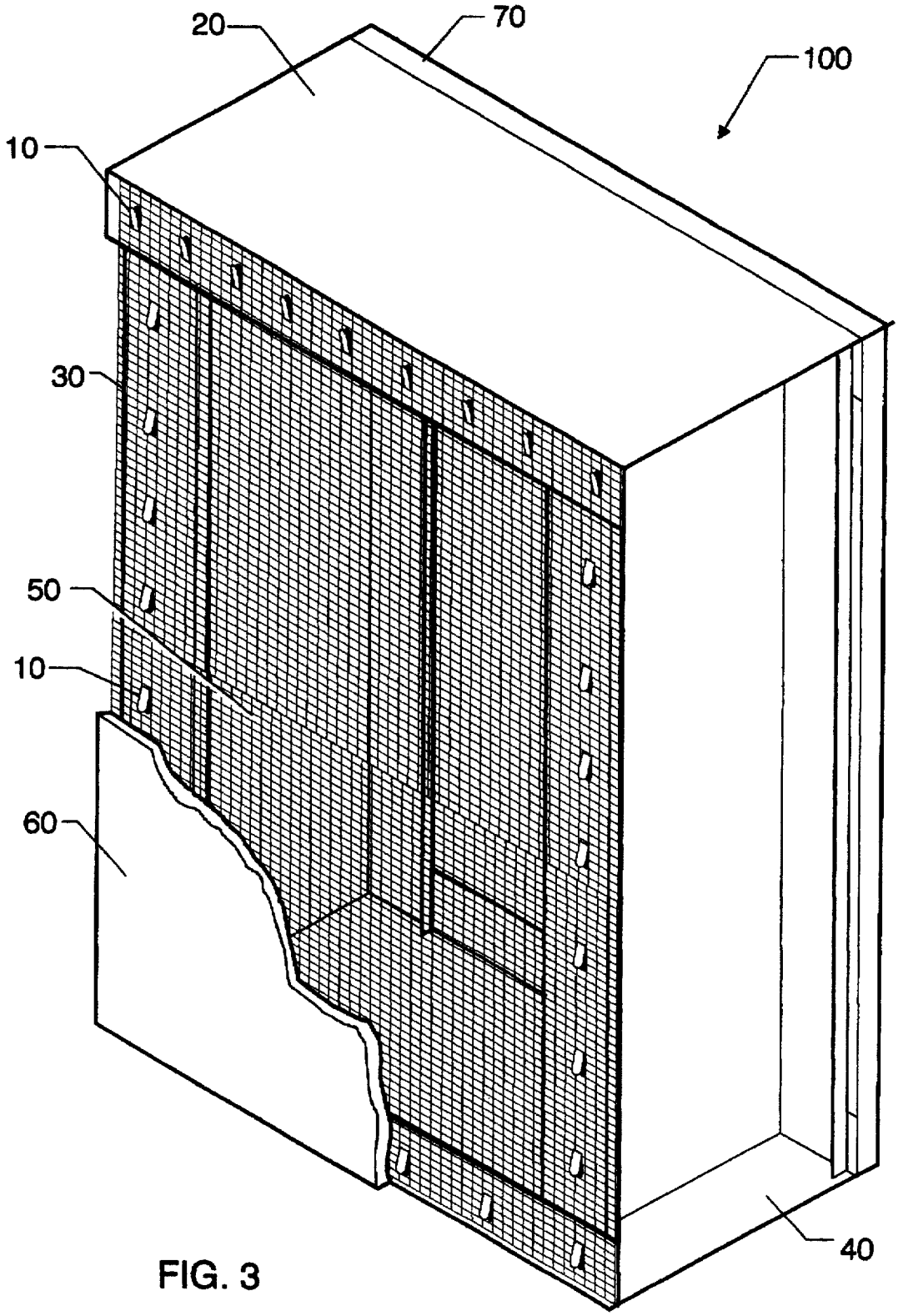
FIG. 3 is an orthographic view of a typical wall showing the preferred embodiment of the present invention.

FIG. 3 shows the most preferred embodiment where both the primary 30 and the secondary 20, 40 metal members have many stamped protrusions. In this case, the metal top track 20, the metal bottom track 40, and the metal studs 30 were all stamped more than one time to yield multiple protrusions. The insulation support material 50 was engaged with each stamped out protrusion providing optimum tension.

The drawings all depict a metal frame comprised of metal members having a standard track and stud configuration. However, as alternative embodiments the primary metal member could also be a joist where the secondary metal members may be either: a purlin or a channel of any configuration known to those skilled in the art. In addition, any combination of primary and secondary metal members may be used. However, a preferred embodiment is a track and stud configuration.

The metal members may be formed from any metal known to those skilled in the art such as steel, anodized aluminum, or sheet metal. Most preferably, the metal is steel.

The metal frame shown in FIG. 3 comprises spaced apart top 20 and bottom 40 tracks. A plurality of parallel elongate studs 30 extend between the top track 20 and the bottom track 40 and are spaced at intervals along the length of the track. The top track 20, bottom track 40, and elongate studs 30 each have a longitudinal axis and each has at least one portion thereof stamped out to protrude on one side forming an angle between the protruded portion 10 and the longitudinal axis. An angle of about 20 degrees is preferred. The stamped out protrusion engages the insulation support material 50. The insulation support material 50, metal members 20, 30, and 40, and exterior sheathing 70 form a cavity in the wall where insulation is blown therebetween.

Figure 4A:
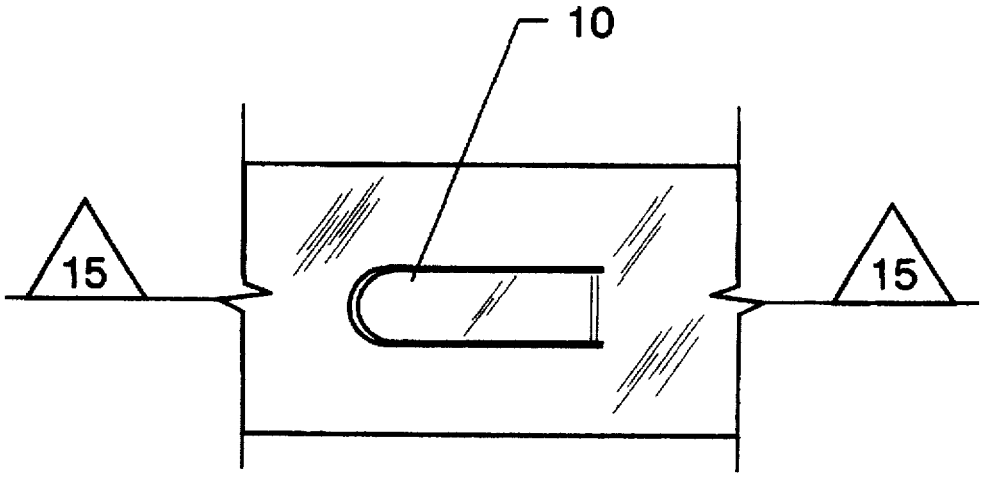
FIG. 4A is a front view of the stamped out protruded portion of the present invention.
Figure 4B:
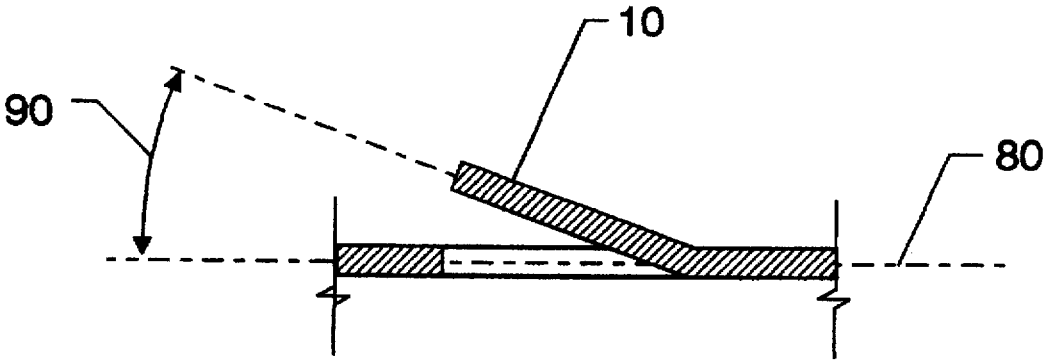
FIG. 4B is a cross-section view of the stamped out protruded portion of the present invention.

FIG. 4A is a front view of the stamped out protrusion 10 and FIG. 4B is a cross-sectional view of the stamped out protrusion 10 taken along line 15. The metal member has a longitudinal axis 80 and a stamped portion 10 such that an angle 90 is formed between the longitudinal axis 80 and the stamped portion 10. The angle formed must be sufficient to hold the insulation support material without causing the support material to fall off the metal member. Any angle would satisfy this requirement. If the angle is 90 degrees, a means for preventing the insulation support material from sliding off of the protrusion may be employed. Such a means may be a barb, an arrowhead or simply an additional bend in the protrusion. The best results were found when an acute angle was formed between the stamped portion and the longitudinal axis. Most preferably an angle of about 20 degrees was found to be suitable for this application.

Although the protrusions of the present invention are stamped out of the metal member, as an alternative, a second member could be fastened onto the metal member to form a protrusion having the configuration mentioned above. For example a prestamped metal strip could be attached to the metal member using an adhesive, welding, or any other method of attachment known to those skilled in the art. However, the present invention preferably addresses a unibody construction wherein the protrusion is formed directly from the metal member.

Any insulation support material known to those skilled in the art may be used for the system of the present invention. However preferred types of insulation support material include: nylon netting, fabric, reinforced material, or a thin translucent cloth material known as Isomesh® commercially available from Ark-Seal Corporation. The stamped out protrusion engages the insulation support material by such methods as hooking onto the insulation support material or by piercing the material. Most preferably, the insulation support material is hooked on to the stamped out protrusions.

The method of the present invention involves providing a metal frame having a plurality of metal members wherein at least two opposing metal members have at least one portion thereof stamped out to protrude on one side and an exterior sheathing attached to an opposing side. An insulation support material is engaged and tensioned on the stamped out protruded portions of the metal frame such that a cavity forms between the exterior sheathing and the insulation support material. Lastly, insulation is blown into the cavity.

The system and method of the present invention allows for positive restraint of the insulation support material and high density insulation. Thus, a high "R" value is achieved. In addition, installation is independent of weather conditions, requires no additional tools and is more efficient than those systems currently used.

The following example illustrates the method of the present invention. This example is merely illustrative and intended to enable those skilled in the art to practice the invention in all of the embodiments flowing therefrom, and does not in any way limit the scope of the invention as defined in the claims.

EXAMPLE

Two steel tracks and two steel studs were stamped out using a hand held die punch to yield a protrusion having a 20 degree angle between the protruded steel portion and the longitudinal axis of the steel track or stud. The tracks were die punched at 1.5 inch intervals along one edge where the studs were die punched at 2 inch intervals along one edge. The punched tracks and studs were assembled to form a frame following conventional construction fabrication techniques. The exterior sheathing was attached to the non-punched side of the top and bottom tracks. The nylon insulation support netting was first attached to the protrusions on the top track by hooking the netting over the protrusions. The netting was then extended downward, maintaining a slight tension, and hooked on to the protrusions on the bottom track. Lastly, the netting was secured to the studs by the installer running a hand over the protrusions in the direction of orientation. The orientation for the protrusions on the studs may be either upward, downward, left facing or right facing. Thus, a cavity was formed between the netting and the exterior sheathing. Lastly, a small opening was cut in the netting and the insulation was blown into the cavity using standard techniques.

What is claimed is:

1. A blown-in insulation support system for metal frame construction comprising:

an insulation support material selected from the group consisting of: a nylon netting; a fabric; a reinforced material; and a thin translucent cloth material for holding insulation; and a metal frame comprising a plurality of metal members, wherein at least two opposing metal members have at least one portion thereof stamped out to protrude on one side and an exterior sheathing attached to an opposing side, and wherein each stamped out protrusion engages and tensions the insulation support material.

2. A blown-in insulation support system for metal frame construction according to claim 1, wherein the insulation support material is a nylon netting.

3. A blown-in insulation support system for metal frame construction according to claim 1, wherein the metal member is selected from the group consisting of: a primary metal member and a secondary metal member.

4. A blown-in insulation support system for metal frame construction according to claim 3, wherein the primary metal member is selected from the group consisting of: a stud and a joist; and the secondary metal member is selected from the group consisting of: a purlin; a channel; and a track.

5. A blown-in insulation support system for metal frame construction according to claim 1, wherein each metal member is formed from steel.

6. A blown-in insulation support system for metal frame construction according to claim 1, wherein each metal member has a longitudinal axis and wherein the stamped portion and the longitudinal axis form an acute angle.

7. A blown-in insulation support system for metal frame construction according to claim 6, wherein the stamped portion and the longitudinal axis form an angle of about 20 degrees.

8. A blown-in support system for steel frame construction comprising:

a nylon net; and a steel frame comprising spaced apart steel top and bottom tracks and a plurality of parallel elongate steel studs extending between the top track and the bottom track spaced at intervals along the length of each track, wherein the top track, the bottom track and the elongate studs each have a longitudinal axis and each has at least one portion thereof stamped out to protrude on one side at an angle of about 20 degrees between the protruded portion and the longitudinal axis and an exterior sheathing attached to an opposing side, and wherein each stamped out protrusion engages and tensions the nylon net.

9. A method for installing blown-in insulation in metal frame construction, the method comprising the steps of:

a) providing a metal frame having a plurality of metal members wherein at least two opposing metal members have at least one stamped portion thereof stamped out to protrude on one side and an exterior sheathing attached to an opposing side;

b) engaging and tensioning an insulation support material on the stamped out protruded portions of the opposing metal members forming a cavity between the exterior sheathing and the insulation support material; and c) blowing insulation into the cavity.

10. A method for installing blown-in insulation in metal frame construction according to claim 9, wherein the metal members are selected from the group consisting of: primary metal members and secondary metal members.

11. A method for installing blown-in insulation in metal frame construction according to claim 10, wherein the primary metal members are selected from the group consisting of: a stud and a joist; and the secondary metal members are selected from the group consisting of: a purlin; a channel; and a track.

12. A method for installing blown-in insulation in metal frame construction according to claim 9, wherein the metal members are formed from steel.

13. A method for installing blown-in insulation in metal frame construction according to claim 12, wherein the metal members are selected from the group consisting of: primary metal members and secondary metal members.

14. A method for installing blown-in insulation in metal frame construction according to claim 13, wherein the primary metal members are selected from the group consisting of: a stud and a joist; and the secondary metal members are selected from the group consisting of: a purlin; a channel; and a track.

15. A method for installing blown-in insulation in metal frame construction according to claim 9, wherein the insulation support material is selected from the group consisting of: a nylon netting; a fabric; a reinforced material; and a thin translucent cloth material for holding insulation.

16. A method for installing blown-in insulation in metal frame construction according to claim 15, wherein the insulation support material is a nylon netting.

17. A method for installing blown-in insulation in metal frame construction according to claim 9, wherein the insulation support material is engaged by hooking the insulation support material on the stamped out protruded portions of the opposing metal members.

18. A method for installing blown-in insulation in steel frame construction, the method comprising the steps of:

a) providing a steel frame comprising spaced apart steel top and bottom tracks and a plurality of parallel elongate steel studs extending between the top track and the bottom track spaced at intervals along the length of each track, wherein the top track, the bottom track and the elongate studs each have a longitudinal axis and each has at least one portion thereof stamped out to protrude at an angle of about 20 degrees between the protruded portion and the longitudinal axis and an exterior sheathing attached to an opposing side;

b) hooking and tensioning a nylon net onto the stamped out protruded portions of the steel frame forming a cavity between the exterior sheathing and the nylon net; and c) blowing insulation into the cavity.

* * * * *